US005348109A

United States Patent [19]

Griffin

[11] Patent Number: 5,348,109

[45] Date of Patent: Sep. 20, 1994

[54] CUTTER ASSEMBLIES AND CUTTING ELEMENTS FOR ROTARY DRILL BITS

[75] Inventor: Nigel D. Griffin, Whitminster, England

[73] Assignee: Camco Drilling Group Ltd., Gloucestershire, England

[21] Appl. No.: 131,716

[22] Filed: Oct. 5, 1993

[30] Foreign Application Priority Data

Oct. 7, 1992 [GB] United Kingdom ..... 9221082
May 18, 1993 [GB] United Kingdom ..... 9310159

[51] Int. Cl.[5] ..... E21B 10/46
[52] U.S. Cl. ..... 175/434; 175/428
[58] Field of Search ..... 175/426, 428, 434, 435

[56] References Cited

U.S. PATENT DOCUMENTS 4,987,800 1/1991 Gasan et al. ..... 175/428 X
5,135,061 8/1992 Newton, Jr. ..... 175/428
5,213,171 5/1993 Clench et al. ..... 175/428 X

*Primary Examiner*—Thuy M. Bui

[57] ABSTRACT

A cutter assembly for a rotary drill bit comprises a preform cutting element mounted on a carrier. The cutting element includes a thin cutting table of polycrystalline diamond, defining a front cutting face and a cutting edge bonded to a less hard substrate which is in turn bonded to the carrier. The substrate and/or the carrier comprises a first portion of high erosion resistance, formed for example from tungsten carbide, and a second portion of lower erosion resistance, formed for example from tungsten metal, which is located in the vicinity of the cutting edge of the cutting element so that, in use, the wear flat is mostly formed in the material of lower erosion resistance.

25 Claims, 2 Drawing Sheets

CUTTER ASSEMBLIES AND CUTTING ELEMENTS FOR ROTARY DRILL BITS

BACKGROUND OF THE INVENTION

The invention relates to cutter assemblies and cutting elements for drag-type rotary drill bits for use in drilling or coring holes in subsurface formations.

Such rotary drill bits are of the kind comprising a bit body having a shank for connection to a drill string, a plurality of cutter assemblies mounted at the surface of the bit body, and a passage in the bit body for supplying drilling fluid to the surface of the bit for cleaning and/or cooling the cutters. Each cutter assembly comprises a preform cutting element mounted on the bit body or, more usually, on a carrier which is then mounted on the bit body.

One common form of preform cutting element comprises a tablet, for example circular, having a thin superhard cutting table of polycrystalline diamond bonded to a thicker substrate of a material which is less hard than the polycrystalline diamond. The preform cutting element is then mounted on the carrier, for example by a process known as "LS bonding".

The carrier, which is usually generally cylindrical in shape, is received in a socket in the surface of the bit body. The bit body itself may be machined from metal, usually steel, or may be moulded using a powder metallurgy process.

In known cutter assemblies of this type it has been usual for the substrate of the cutting element and the carrier itself to be formed from cemented tungsten carbide which has characteristics which render it particularly suitable for this purpose. Thus, it exhibits high rigidity, high resistance to the erosion to which such carriers are subject in use, and hot strength. Also, the coefficient of expansion of tungsten carbide is sufficiently close to the coefficient of expansion of polycrystalline diamond to reduce the residual stresses which can occur when the two materials are bonded together.

However, some of the other characteristics of cemented tungsten carbide have certain disadvantages. For example, cemented tungsten carbide has low toughness (i.e. it is comparatively brittle) and this can lead to failure of such cutter assemblies in use, as a result of impact forces on the assembly. Also after prolonged use of a rotary drill bit, a large wear flat develops on the substrate and carrier rearwardly of the diamond table and bears on the formation being drilled. Due to the high abrasion resistance of tungsten carbide, this leads to high heat generation due to friction, with consequent overheating and premature failure of the polycrystalline diamond table of the preform cutting element. The combination of low toughness and high heat generation can also cause heat checking of the tungsten carbide carrier material with resultant premature failure of the bit. "Heat checking" is a term in the art which refers to craze cracking of the wear flat which develops on the carrier due to abrasive heating with intermittent quenching by the drilling fluid.

Accordingly, there may be advantages in using for the substrate and/or carrier a material which is less abrasion resistant than the tungsten carbide normally employed. For example, there has been proposed in our British Patent Specification No. 2216577 the use, for the carrier of such a cutter assembly, of a material containing at least a proportion of tungsten metal. Our British Patent Specification No. 2228031 discloses the use in a cutting element of a substrate containing at least a proportion of tungsten metal.

The presence of tungsten metal in the carrier or substrate which, as described in the earlier applications, may be an addition to the tungsten carbide or may entirely replace the tungsten carbide, has the effect of reducing the abrasion resistance of the carrier or substrate so as to reduce the additional heat generated by rubbing of the wear flat on the formation being drilled. In addition the tungsten-containing material may be even stronger than cemented tungsten carbide in resisting the cantilever bending and shear forces to which cutter assemblies may be subject in use.

However, it is desirable that the abrasion resistance of the carrier and substrate should be reduced without also significantly reducing its erosion resistance. In use the cutter assemblies are subjected to the substantial eroding effect of drilling fluid flowing over the cutter assemblies continuously during drilling. Existing cutter assemblies where the carrier and substrate comprise cemented tungsten carbide have considerable resistance to such erosion. The use of tungsten metal (or other material of lower abrasion resistance than tungsten carbide) in the carrier or substrate tends however to reduce the erosion resistance and this may limit the extent to which such materials may be used.

SUMMARY OF THE INVENTION

The present invention sets out to provide a form of cutting element and cutter assembly where the abrasion resistance of the element or assembly is reduced without also significantly reducing its erosion resistance.

According to one aspect of the invention, there is provided a cutting element for a rotary drill bit comprising a thin superhard cutting table of polycrystalline diamond material, defining a front cutting face and a cutting edge, bonded to a less hard substrate, wherein the substrate comprises at least a first portion of high erosion resistance and a second portion of lower erosion resistance, the portion of lower erosion resistance having at least a part thereof located adjacent the cutting edge of the superhard cutting table.

Although reference is made only to first and second portions of the substrate, it will be appreciated that the substrate might also include further portions having the characteristics of the first and/or second portions, or having different characteristics.

Normally the portion of lower erosion resistance will also be of lower abrasion resistance. Since this portion has at least a part thereof adjacent the cutting edge, as the cutting element is used and a wear flat develops the wear flat will be formed wholly or mainly in the portion of lower erosion and abrasion resistance. Thus, as previously explained, this will reduce the additional heat generated by rubbing of the wear flat on the formation being drilled. At the same time, the portion of high erosion resistance outside the wear flat will resist the eroding effect of the flow, over the cutting element, of the drilling fluid.

The portion of the substrate of high erosion resistance may provide at least half, and preferably the majority, of the exposed peripheral surface of the substrate.

Preferably, the portion of the substrate of lower erosion resistance provides part of the exposed peripheral surface of the substrate adjacent the cutting edge. Alternatively or additionally, part or all of the exposed peripheral surface of the substrate adjacent the cutting edge may be provided initially by a thin layer of the portion of high erosion resistance, which layer wears away in use of the cutting element to expose to the formation being drilled a surface of the portion of lower erosion resistance.

A cutting element according to the invention may be mounted on a carrier, also in accordance with the invention, using known bonding techniques. However, the invention includes within its scope arrangements in which the substrate of the cutting element is of such a size and shape that it may be mounted directly on the bit body without first being mounted on a preformed carrier.

The invention also provides, in a second aspect, a cutter assembly for a rotary drill bit comprising a preform cutting element of any of the kinds referred to above mounted on a carrier. In this case the carrier also may comprise a first portion of high erosion resistance and a second portion of lower erosion resistance, the portion of lower erosion resistance being located in the vicinity of the cutting edge of the cutting element, so that, in use, if the wear flat extends into the carrier such wear flat will extend into the lower erosion resistant portion of the carrier.

Generally speaking, an erosion resistant outer layer of a carrier or substrate in accordance with the present invention is also likely to be of greater abrasion resistance than the tungsten-containing material making up the main body of the carrier or substrate. However, this greater abrasion resistance is only significant on that part of the carrier or substrate which bears on the formation being drilled during operation of the drill bit. To provide the necessary erosion resistance, the erosion resistant layer requires to be only of very small thickness, for example about 5 microns, and this layer will be quickly worn away by abrasion during initial operation of the drill bit, so that by the time the wear flat has developed the tungsten-containing main body of the carrier or substrate will be exposed and bearing on the formation rearwardly of the diamond layer, thus providing the advantages of low abrasion resistance in this area, whereas the rest of the exposed surface of the carrier and substrate will maintain the erosion resistant layer intact, thus providing the desirable resistance to erosion caused by drilling fluid.

Although it will usually be convenient to provide the erosion resistant surface layer over the whole outer surface of the carrier and/or substrate, the invention includes within its scope arrangements in which only selected areas of the outer surface are made erosion resistant. For example, since the carrier is normally received in a socket within the bit body, the portion of the carrier shrouded by the bit body is in any case protected from erosion and thus it may only be necessary to render erosion resistant those portions of the surface of the carrier which are not shrouded by the material of the bit body. Accordingly, in order to minimise the proportion of the carrier which is subject to erosion by the drilling fluid, it is desirable that as much of the carrier as possible is shrouded by the bit body, and preferably substantially the whole of the carrier is shrouded by the bit body. Such shrouding of carriers is described in our British Patent Specification No. 2151283 which relates however to the shrouding of carriers formed from steel which are particularly susceptible to erosion.

In cutting elements or carriers according to the invention the portion of high erosion resistance may be formed from cemented tungsten carbide, for example tungsten carbide incorporating about 10% cobalt. The portion of lower erosion resistance may also be formed from cemented tungsten carbide, but a form of such carbide of lower erosion resistance. For example, it may incorporate a higher proportion of cobalt, such as about 20%, or another additive which reduces its erosion resistance.

Alternatively or additionally the portion of lower erosion resistance may be formed by replacing the tungsten carbide partly or entirely by tungsten metal as described in the prior specifications referred to above.

In any of the above arrangements, the greater erosion resistance of the surface of the substrate or carrier may be provided by carburisation, or case hardening, of the surface to a predetermined depth. As is well known, carburisation consists in enriching the carbon content at the surface of a metal by heating in carbon-rich material. In the present case, carburisation develops a surface layer of tungsten carbide. Various carburisation techniques may be employed, but such techniques are well known and will not therefore be described in detail.

In an alternative arrangement according to the invention, the greater erosion resistance may be provided by application of an erosion resistant coating to the surface of a preformed substrate or carrier. Again, the application of hard, erosion resistant coatings to materials is well known. For example, it is known to apply an erosion resistant coating to the surface of a bit body, around the cutter assemblies, and similar techniques may be employed according to the present invention to provide an erosion resistant coating on the substrate or carrier itself. For example, the coating may be in the form of a sprayed-on layer of tungsten carbide. Other hard facing techniques are described in our British Patent Applications Nos. 2190024 and 2211874.

As is well known, substrates and carriers for cutter assemblies are often formed by a moulding process, such as a sintering or infiltration process or by hot pressing. In a further alternative method of providing greater erosion resistance at the surface of the tungsten-containing substrate or carrier, this may be achieved by differentially moulding a surface layer of the substrate or carrier, that is to say by including in the body of material from which the substrate or carrier is moulded an outer layer of material which differs from the material forming the main body of the substrate or carrier, the material of the outer layer being such as to provide, in the finished substrate or carrier, an outer layer of greater erosion resistance. For example, the outer layer may be formed from tungsten carbide, or may comprise a mixture of tungsten metal with a high proportion of tungsten carbide.

DETAILED DESCRIPTION OF THE PREFERRED EMBODIMENTS

Figure 1:
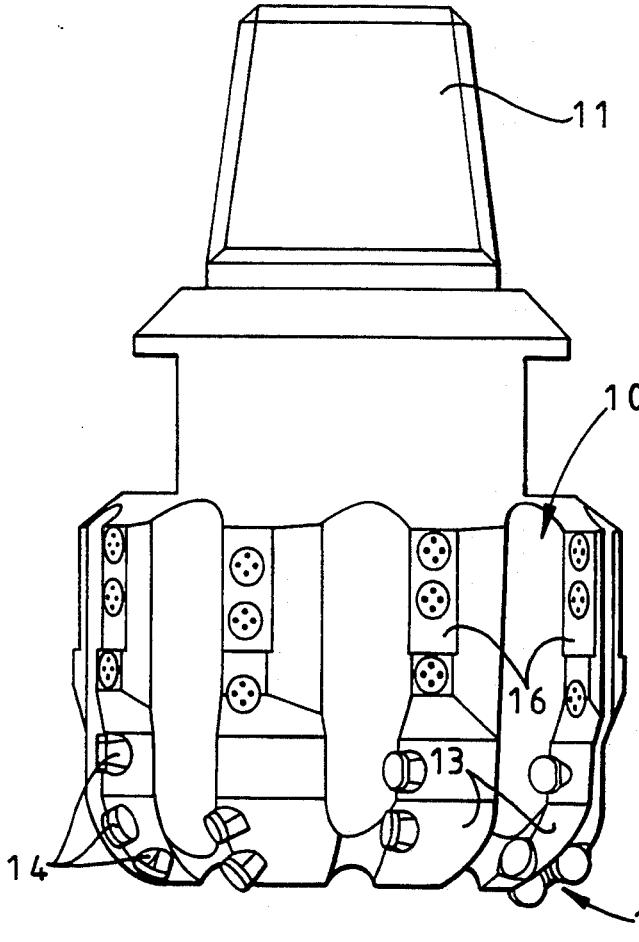
FIG. 1 is a side elevation of a typical drill bit incorporating cutting elements and cutter assemblies according to the invention.
Figure 2:
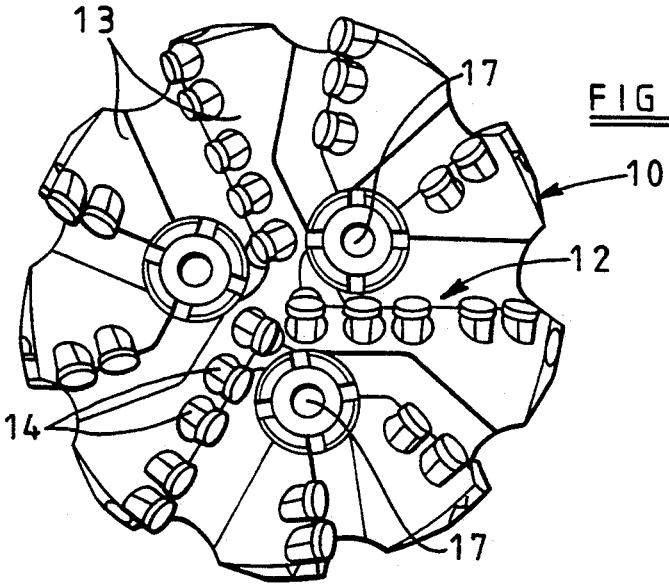
FIG. 2 is an end elevation of the drill bit shown in FIG. 1.

FIGS. 1 and 2 show a typical full bore drill bit incorporating cutting elements and cutter assemblies according to the present invention. The bit body 10 is machined from steel and has a threaded shank 11 at one end for connection to the drill string. The operative end face 12 of the bit body is formed with a number of blades 13 radiating from the central area of the bit, and the blades carry cutter assemblies 14 spaced apart along the length thereof. The bit has a gauge section including kickers 16 which contact the walls of the borehole to stabilise the bit in the borehole. A central passage (not shown) in the bit body and shank delivers drilling fluid through nozzles 17 in the end face 12 in known manner.

Figure 3:
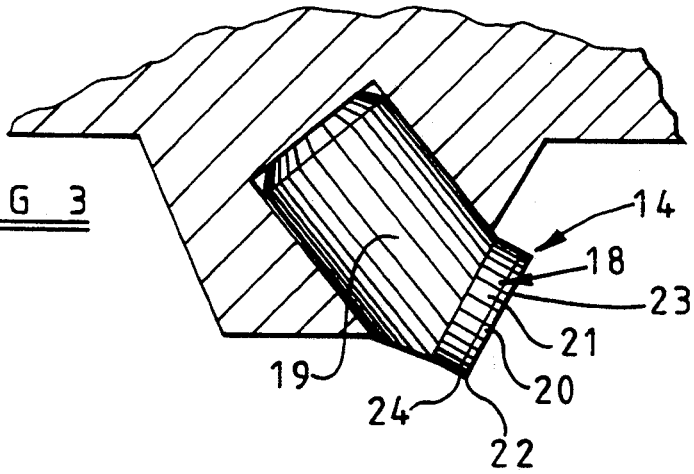
FIG. 3 is a side elevation of a typical cutter assembly according to the invention.

As shown in greater detail in FIG. 3, each cutter assembly 14 comprises a preform cutting element 18 mounted on a carrier 19 in the form of a stud which is located in a socket in the bit body. Each preform cutting element is in the form of a circular tablet comprising a thin facing layer 20 of polycrystalline diamond bonded to a less hard substrate 21, both layers being of uniform thickness. The rear surface of the substrate is bonded, for example by the process known as LS bonding, to a suitably orientated surface on the stud.

It will be appreciated that the drawings illustrate only one example of the many possible variations of the type of bit and cutter assembly to which the invention is applicable and many other arrangements are possible. For example, the bit body, instead of being machined from steel, may be moulded from tungsten carbide matrix infiltrated with a binder alloy. Also, instead of the cutting element being a two-layer preform, comprising a diamond table and a less hard substrate, it may comprise a tablet of thermally stable polycrystalline diamond material, mounted on a carrier. Instead of the configuration shown, the carrier may be in the form of a generally cylindrical stud, the circular cutting element being mounted on an end surface of the stud and being generally coaxial therewith.

In a further alternative, the substrate 21 may be of sufficient axial length so as itself to form a coaxial stud which may be received directly in a socket in the bit body, making it unnecessary to mount the cutting element on a separately pre-formed carrier.

The cutting edge of the cutting element, indicated at 22 in FIG. 3, comprises that portion of the cutting element, between the cutting face 23 and the peripheral surface 24 of the diamond table which engages the surface of the formation being drilled. As drilling proceeds a wear flat forms along the cutting edge and extends into the substrate 21 and, after considerable wear, even into the material of the carrier 19.

In FIGS. 4–7 the polycrystalline diamond cutting table is indicated at 20, the cutting edge is indicated at 22 and the less hard substrate is indicated generally at 21.

Figure 4:
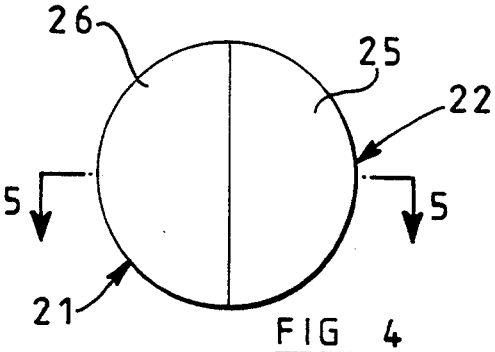
FIG. 4 is diagrammatic rear view of a cutting element in accordance with the invention.
Figure 5:
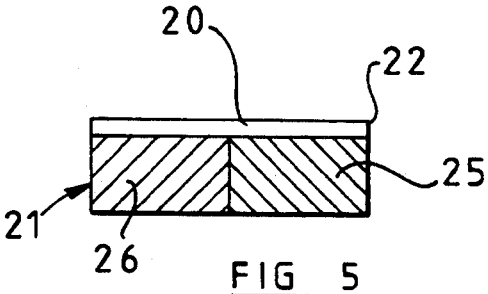
FIG. 5 is a section on the Line 5—5 of FIG. 4, FIG. 6 and FIG. 7 are similar views to FIG. 4 of alternative embodiments of the invention.

In the embodiment of FIG. 4 the substrate 21 comprises two generally semi-circular halves, the half 25 adjacent the cutting edge 22 being of low erosion resistance and the half 26 further from the cutting edge 22 being of high erosion resistance.

Figure 6:
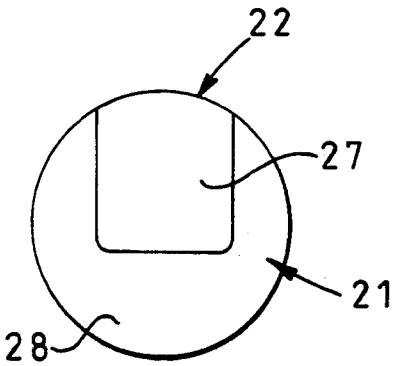

In the embodiment of FIG. 6 the portion of low erosion resistance comprises a body of material 27 embedded in a main body 28 of high erosion resistance, a portion of the body 27 being exposed along the periphery of the substrate 21 adjacent the cutting edge 22.

Figure 7:
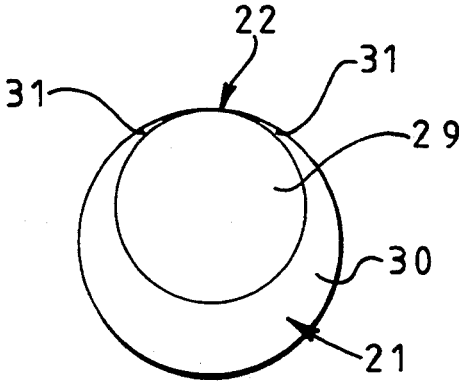

In the embodiment of FIG. 7, also, a body 29 of low erosion resistance is embedded within a main body 30 of high erosion resistance. In this case the low erosion resistant body 29 is generally circular so that, initially, only a small portion of the body 29 is exposed at the periphery of the substrate 21 adjacent the cutting edge 22, the rest of the body 29 along the cutting edge being overlaid by thin layers 31 of the high erosion resistant material. As the wear flat develops through the abrading action of the formation, the thin layers 31 are increasingly worn away, so as to expose the low erosion and abrasion resistant material to the formation.

The invention includes within its scope arrangements where the low erosion resistant body is wholly embedded in the main part of the substrate so that, initially, the high erosion portion 30 provides the whole of the peripheral surface of the substrate, the low erosion resistant material only becoming exposed to the formation as the wear flat develops.

In use of the embodiments according to the invention, the wear flat is mainly formed in the body 25, 27 or 29 of low erosion resistant material, while at least half of the rest of the substrate and preferably the majority of the substrate as in FIGS. 6 and 7, presents a surface of high erosion resistance to the abrasive effect of the drilling fluid flowing over the cutting element.

The invention includes within its scope arrangements where the carrier to which the cutting element is bonded, for example by brazing, also has a construction similar to that shown in FIGS. 4–7, or otherwise in accordance with the invention, so as to provide a similar effect when the wear flat extends into the material of the carrier.

The difference in erosion resistance between the portions of the substrate or carrier may be effected in any convenient manner. For example, the high erosion resistant portion may be of conventional construction comprising cemented tungsten carbide incorporating about 10% cobalt. The erosion resistance of the second portion of the substrate 25, 27 or 29, may be reduced by increasing the amount of cobalt, for example up to 20%, or by adding some other suitable additive to the tungsten carbide to reduce its erosion resistance. Thus, tungsten metal may be added to the tungsten carbide or the lower erosion resistant portion may be entirely formed from tungsten metal. For example in one embodiment the lower erosion resistant portion of the substrate or carrier may comprise a metal matrix composite having the following composition (percentages by weight):

| | |
|---|---|
| W | 95% |
| Ni | 3.5% |
| Fe | 1.5% |

In this example the percentage of tungsten metal is greater than 80%, but lower percentages of tungsten metal may also provide advantage. Preferably, however, the material contains at least about 50% tungsten metal. Lower percentages of tungsten metal may be appropriate in the case where the material of the lower erosion resistant portion also includes tungsten carbide, such as a metal matrix composite including tungsten metal particles and tungsten carbide particles in a metal binder phase.

Where the material includes tungsten carbide, the tungsten metal and tungsten carbide together preferably constitute at least about 50% by weight, and more preferably 80%, of the material from which the lower erosion resistant portion is formed.

In another embodiment of the invention, as previously described, the required configuration of the substrate or carrier may be formed by first forming the substrate or carrier wholly from a material of lower erosion resistance, and then providing the portion of higher erosion resistance by carburisation, or surface hardening, of part or all of the peripheral surface of the substrate or carrier, using any of the well known carburisation techniques. Such carburisation is effected to a predetermined depth. The depth of erosion resistance may, typically, be of the order of 5 microns.

In the case where such surface hardening is effected around the whole peripheral surface of the substrate or carrier the portion of lower erosion resistance, which in this case will comprise the whole of the interior of the substrate or carrier, then only becomes exposed to the formation as the wear flat develops and wears away the surface hardened portion in the vicinity of the cutting edge.

Alternatively the outer surfaces of the carrier and/or substrate, or at least the portions thereof which are exposed when the cutter assembly is fitted to the bit body, may have an erosion resistant coating applied thereto after forming of the carrier and/or substrate. For example, the coating may be in the form of a sprayed-on layer of tungsten carbide.

Alternatively, in the case where the carrier and/or substrate is formed by a moulding process, such as a sintering or infiltration process or hot pressing, the erosion resistance of the outer surface may be provided by including in the body of the material from which the carrier or substrate is moulded an outer layer of material the composition of which is such that, after moulding, the outer layer has increased erosion resistance when compared with the tungsten containing material of the main body of the carrier or substrate. For example, where the main body of the carrier or substrate is formed from tungsten metal powder, or a combination of tungsten metal and tungsten carbide powder in a metal binder phase, the outer layer may be formed entirely of tungsten carbide powder in a metal binder phase or a mixture of tungsten metal and tungsten carbide containing a high proportion of tungsten carbide.

I claim:

1. A cutting element for a rotary drill bit comprising a thin superhard cutting table of polycrystalline diamond material, defining a front cutting face and a cutting edge, bonded to a less hard substrate, wherein the substrate comprises at least a first portion of high erosion resistance and a second portion of lower erosion resistance, the portion of lower erosion resistance having at least a part thereof located adjacent the cutting edge of the superhard cutting table.

2. A cutting element according to claim 1, wherein the portion of the substrate of high erosion resistance provides at least half of the exposed peripheral surface of the substrate.

3. A cutting element according to claim 1, wherein the portion of the substrate of lower erosion resistance provides part of the exposed peripheral surface of the substrate adjacent the cutting edge.

4. A cutting element according to claim 1, wherein at least part of the exposed peripheral surface of the substrate adjacent the cutting edge is provided initially by a thin layer of the portion of high erosion resistance, which layer wears away in use of the cutting element to expose to the formation being drilled a surface of the portion of lower erosion resistance.

5. A cutting element according to claim 1, wherein the portion of high erosion resistance is formed from cemented tungsten carbide.

6. A cutting element according to claim 5, wherein the portion of lower erosion resistance is also formed from cemented tungsten carbide, but includes an additive which reduces its erosion resistance compared to the erosion resistance of said portion of high erosion resistance.

7. A cutting element according to claim 5, wherein the portion of lower erosion resistance is formed by replacing the tungsten carbide at least partly by tungsten metal.

8. A cutting element according to claim 1, wherein the greater erosion resistance of the surface of the substrate is provided by carburisation of the surface to a predetermined depth.

9. A cutting element according to claim 1, wherein the greater erosion resistance of the surface of the substrate is provided by application of an erosion resistant coating to the surface of a preformed substrate.

10. A cutting element according to claim 9, wherein the coating is in the form of a sprayed-on layer of tungsten carbide.

11. A cutting element according to claim 1, wherein the substrate is formed by a moulding process, and wherein the greater erosion resistance at the surface of the substrate is achieved by differentially moulding a surface layer of the substrate by including in a body of material from which the substrate is moulded an outer layer of material which differs from the material forming the main body of the substrate, the material of the outer layer being such as to provide, in the finished substrate, an outer layer of greater erosion resistance.

12. A cutting element according to claim 11, wherein the main body of the substrate is formed from tungsten metal and the outer layer is formed at least in part from tungsten carbide.

13. A cutter assembly for a rotary drill bit comprising a preform cutting element mounted on a carrier, the cutting element including a thin superhard cutting table of polycrystalline diamond material, defining a front cutting face and a cutting edge, bonded to a less hard substrate which is mounted on the carrier, the carrier comprising a first portion of high erosion resistance and a second portion of lower erosion resistance, the portion of lower erosion resistance being located in the vicinity of the cutting edge of the cutting element, so that, in use, if the wear flat extends into the carrier such wear flat will extend into the lower erosion resistant portion of the carrier.

14. A cutter assembly according to claim 13, wherein the portion of the carrier of high erosion resistance provides at least half of the exposed peripheral surface of the carrier.

15. A cutter assembly according to claim 13, wherein the portion of the carrier of lower erosion resistance provides part of the exposed peripheral surface of the carrier adjacent the cutting edge.

16. A cutter assembly according to claim 13, wherein at least part of the exposed peripheral surface of the carrier adjacent the cutting edge is provided initially by a thin layer of the portion of high erosion resistance, which layer wears away in use of the cutting element to expose to the formation being drilled a surface of the portion of lower erosion resistance.

17. A cutter assembly according to claim 13, wherein the portion of high erosion resistance is formed from cemented tungsten carbide.

18. A cutter assembly according to claim 17, wherein the portion of lower erosion resistance is also formed from cemented tungsten carbide, but includes an additive which reduces its erosion resistance compared to the erosion resistance of said portion of high erosion resistance.

19. A cutter assembly according to claim 17, wherein the portion of lower erosion resistance is formed by replacing the tungsten carbide at least partly by tungsten metal.

20. A cutter assembly according to claim 13, wherein the greater erosion resistance of the surface of the carrier is provided by carburisation of the surface to a predetermined depth.

21. A cutter assembly according to claim 13, wherein the greater erosion resistance of the surface of the carrier is provided by application of an erosion resistant coating to the surface of a preformed carrier.

22. A cutter assembly according to claim 21, wherein the coating is in the form of a sprayed-on layer of tungsten carbide.

23. A cutter assembly according to claim 13, wherein the carrier is formed by a moulding process, and wherein the greater erosion resistance at the surface of the carrier is achieved by differentially moulding a surface layer of the carrier by including in a body of material from which the carrier is moulded an outer layer of material which differs from the material forming the main body of the carrier, the material of the outer layer being such as to provide, in the finished carrier, an outer layer of greater erosion resistance.

24. A cutter assembly according to claim 23, wherein the main body of the carrier is formed from tungsten metal and the outer layer is formed at least in part from tungsten carbide.

25. A cutter assembly for a rotary drill bit comprising a preform cutting element mounted on a carrier, the cutting element including a thin superhard cutting table of polycrystalline diamond material, defining a front cutting face and a cutting edge, bonded to a less hard substrate which is mounted on the carrier, the substrate and carrier each comprising a first portion of high erosion resistance and a second portion of lower erosion resistance, at least parts of the portions of lower erosion resistance being located in the vicinity of the cutting edge of the cutting element.

* * * * *